United States Patent [19]

Traben

[11] 4,220,185

[45] * Sep. 2, 1980

[54] APPARATUS FOR PRODUCING MACHINED TIMBER

[75] Inventor: Josef Traben, Oberkirch, Fed. Rep. of Germany

[73] Assignee: Firma Gebrüder Linck Maschinenfabrik und Eisen/Giesserel Gatterlinck, Oberkirch, Fed. Rep. of Germany

[ * ] Notice: The portion of the term of this patent subsequent to May 2, 1995, has been disclaimed.

[21] Appl. No.: 920,266

[22] Filed: Jun. 29, 1978

Related U.S. Application Data

[63] Continuation-in-part of Ser. No. 760,660, Jan. 19, 1977, Pat. No. 4,143,692, which is a continuation of Ser. No. 607,298, Aug. 25, 1975, Pat. No. 4,086,944.

[30] Foreign Application Priority Data

Nov. 16, 1977 [DE] Fed. Rep. of Germany ..... 2751238

[51] Int. Cl.[3] ..... B27L 9/00

[52] U.S. Cl. ..... 144/3 P; 83/404.4; 83/425.3; 144/120; 144/159; 144/184; 144/323

[58] Field of Search ..... 83/425.3, 404.4, 778; 144/3 R, 3 P, 118, 120, 121, 193 R, 184, 323, 213, 326 R, 172, 178, 162 R, 159

[56] References Cited

U.S. PATENT DOCUMENTS

| | | | |
|---|---|---|---|
| 1,009,688 | 11/1911 | Peterson et al. | 144/120 |
| 1,503,784 | 8/1924 | Dumont | 144/184 |
| 2,619,130 | 11/1952 | Nielsen | 83/778 |
| 3,614,968 | 10/1971 | Hirz | 144/162 R |
| 3,727,654 | 4/1973 | Mochizuki | 144/120 |
| 4,019,548 | 4/1977 | Lenderink et al. | 144/184 |
| 4,086,944 | 5/1978 | Traben | 144/3 P |

*Primary Examiner*—W. Donald Bray

*Attorney, Agent, or Firm*—Schmidt, Johnson, Hovey & Williams

[57] ABSTRACT

Apparatus for producing machined timber from round timber logs comprises a feed device for receiving a log and feeding it longitudinally through at least one machining device whereby the middle region of the log is machined into squared timber. The wood sections lying outside the squared timber, on two mutually opposite sides of the round timber log, are separated into boards or planks during the feed movement of the log in its longitudinal direction, in a plurality of successive cutting operations. The machining device has a plurality of cutters staggered one behind the other, which cutters are combined into groups arranged in a frame which can be driven with an oscillating movement. A presser strip is associated with each cutter, and before each presser strip in the machining direction there is arranged a guide strip which contacts the outer surface of the log being machined.

4 Claims, 9 Drawing Figures

APPARATUS FOR PRODUCING MACHINED TIMBER

This invention is a continuation-in-part of my copending prior application Ser. No. 760,660, filed Jan. 19, 1977 now U.S. Pat. No. 4,143,692, which in turn is a continuation of Ser. No. 607,298, filed Aug. 25, 1975 now U.S. Pat. No. 4,086,944.

BACKGROUND OF THE INVENTION

1. Field of the Invention

The invention relates to an apparatus for producing machined timber from round or substantially round timber logs.

2. Prior Art

In German Published Specification No. 2,514,901 there is described an apparatus in which the middle region of a round timber log is machined into squared timber and the wood sections lying outside the squared timber, on two mutually opposite sides of the log, are separated into boards or planks during the feed movement of the log in its longitudinal direction, in a plurality of successive operations. This apparatus has a feed device for receiving the log and moving it longitudinally, and at least one processing device in which several cutters staggered one behind the other are combined into groups with each group being arranged in a frame which can be driven with an oscillating movement, and a presser strip being associated with each cutter.

Such apparatus makes it possible to machine the whole round timber log with the minimum of waste into high-grade wood products at a viable price, even if high transport costs are involved. Since the apparatus works largely without waste and the machined timber is all solid wood, there results a substantial increase in the volume of the log. Also due to the oscillating movement of the cutters the cutting forces are substantially reduced, so that relatively high cutting speeds and great work outputs can be achieved with low cutting forces.

The surface quality and dimensional accuracy of the wood products produced with the apparatus described above are relatively high. However, it is desirable to increase the possibilities of use of the apparatus even under difficult working conditions, for example in the case of very high working speeds, relatively great thickness of the planks to be produced and unfavourable properties of the timber, and yet still produce wood products having good surface quality and high dimensional accuracy.

SUMMARY

According to the invention there is provided apparatus for producing machined timber from round or substantially round timber logs, comprising a feed device for receiving a log and feeding it longitudinally through at least one machining device whereby the middle region of the log is machined into squared timber and the wood sections lying outside the squared timber, on two mutually opposite sides of the round timber log, are separated into boards or planks during the feed movement of the log in its longitudinal direction, in a plurality of successive cutting operations, the or each machining device comprising a plurality of cutters staggered one behind the other, which cutters are combined into groups with each group arranged in a frame which can be driven with an oscillating movement, a presser strip associated with each cutter, and before each presser strip in the machining direction there is arranged a guide strip which contacts the outer surface of the log being machined.

It has been found that the provision of the guide strips minimises the production of splits and cracks in the surface of the wood products even under unfavourable working conditions. The guide strips effect an exact guidance of the timber. The cutting results are also of very high quality as regards surface quality and dimensional accuracy. Due to the separation of the presser strips and the guide strips it is preferred, for best results, that the presser strips are narrow to effect a relatively high and as far as possible constant forward pressure on the timber, whilst the guide strips are wide for effective guidance of the timber without too high a pressure per unit of area. When the timber being machined has different hardnesses from one side to the other, the guide strips prevent the occurrence of a unilateral yielding in the region of the pressure strips. This is important to minimise scoring.

DESCRIPTION OF THE PREFERRED EMBODIMENTS

Figure 1:
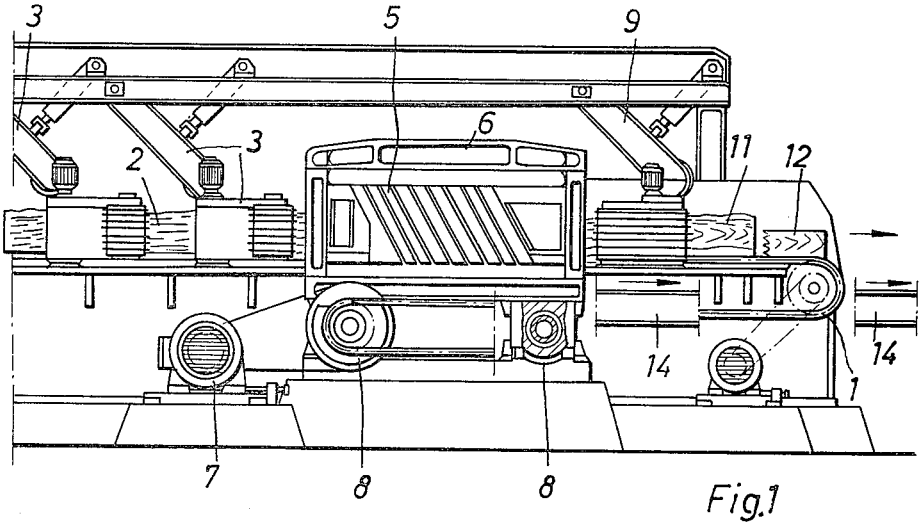
FIG. 1 is a side elevation of an apparatus, by way of example, for producing squared timber and boards or planks from round timber logs.

Referring to the drawings, apparatus for machining round or substantially round timber logs comprises a driven chain bed 1 on which the timber log 2 is transported. The log 2 is pressed on to the chain bed 1 by depressor devices 3. Driven centering devices 4 grasp the log laterally and feed it to two mutually oppositely arranged groups of obliquely staggered cutters 5. In this embodiment, the cutters of each group are arranged in a common frame 6 which is mounted on two eccentric shafts 8 driven by a motor 7, which shafts impart a circular oscillating movement to the frame and the cutters 5 clamped therein. The cutters 5 are placed obliquely and staggered so that the log, which is moved from left to right as viewed in FIGS. 1 and 2, firstly comes between the cutters situated farthest apart and then is moved in the direction of the cutters situated nearer to one another.

Figure 2:
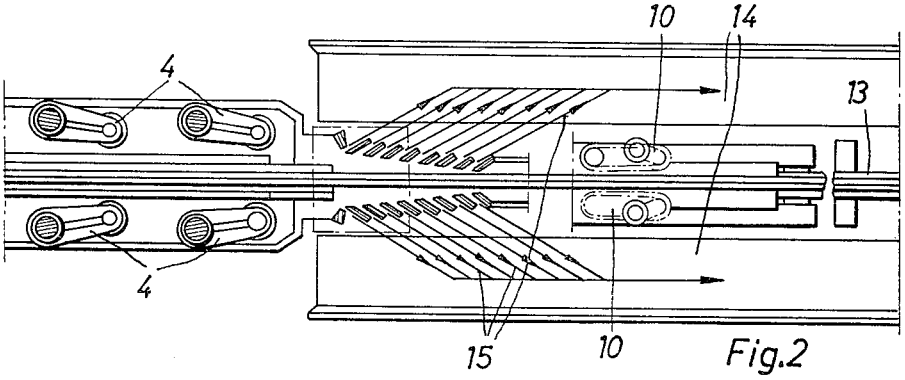
FIG. 2 is a plan view of the apparatus of FIG. 1, the cutters being shown in section and the upper machine parts and the timber logs being omitted.

A depressor device 9 and driven lateral centring devices 10 together with the chain bed 1 form an extractor device for the machined timber, for example in the form of a module 11 or squared timber 12 (FIG. 1). A transport device 13 conveys the machined timber further.

On both sides of the apparatus there are arranged conveyor belts 14 which withdraw the machined boards or planks 15 (FIG. 2) for further working.

Figure 3A:
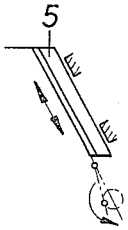
FIGS. 3*a* to 3*c* show diagrammatically possible drive systems for the cutters.
Figure 3B:
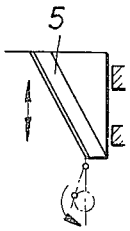

In order to minimize the forward thrust forces, to avoid scores in the timber, to achieve smoothest possible surfaces and to render possible good adaptation to the timber structure, each group of cutters 5 carries out an oscillating motion. FIG. 3*a* shows a crank drive system for a cutter movement parallel with the cutter edge; in this case a drawing cut is obtained. If the stroke movement by the crank drive takes place at an angle to the cutter edge (FIG. 3*b*), then in the downward movement the cutter drive also supplies a large part of the cutting force, so that the foward thrust drive system is relieved of load. In the case of the double crank drive system according to FIG. 3*c* the cutters 5 carry out a circular oscillating motion.

Figure 4A:
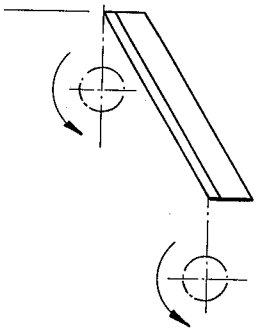
FIG. 4*a* is a schematic representation illustrating the oscillating movement of one of the cutters.
Figure 4:
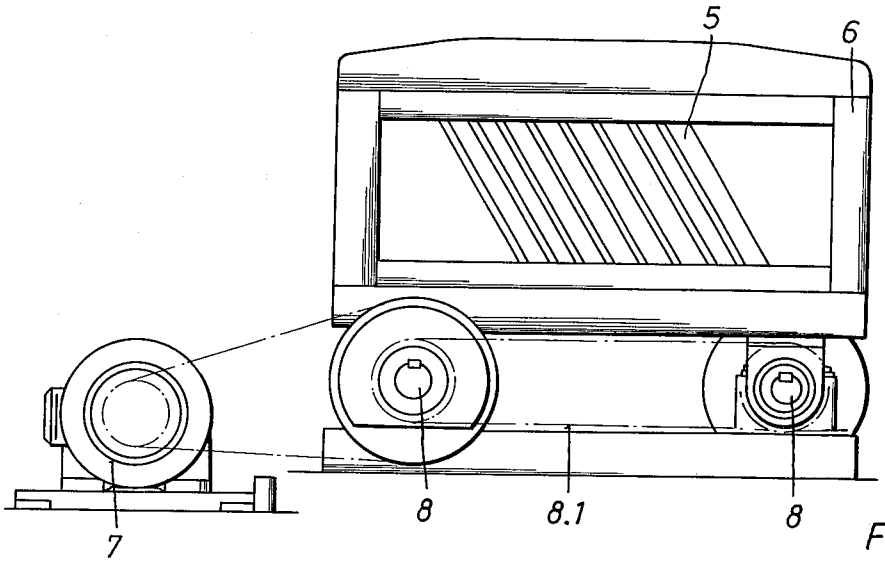
FIG. 4 shows diagrammatically the drive device for a cutter movement according to FIG. 3*c;*

FIG. 4 shows details of an embodiment of a drive apparatus for the cutter movement, the direction of movement of a cutter thus achieved being represented diagrammatically. Through a belt drive 7.1 the motor 7 drives the eccentric shafts 8 which are connected with one another for synchronous movement by a chain drive 8.1. Eccentrics 8.2 are keyed on to the shafts 8.

Figure 3C:
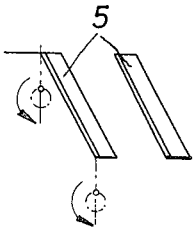

In the embodiment according to FIG. 4, which corresponds to the drive system as shown in FIG. 3*c*, each of the eccentrics 8.2 runs in the bore of a bracket 6.1 connected with the cutter frame 6. In the case of this arrangement each point of the cutter frame 6, and thus also each point of the cutters 5, carries out a circular motion.

Figure 5:
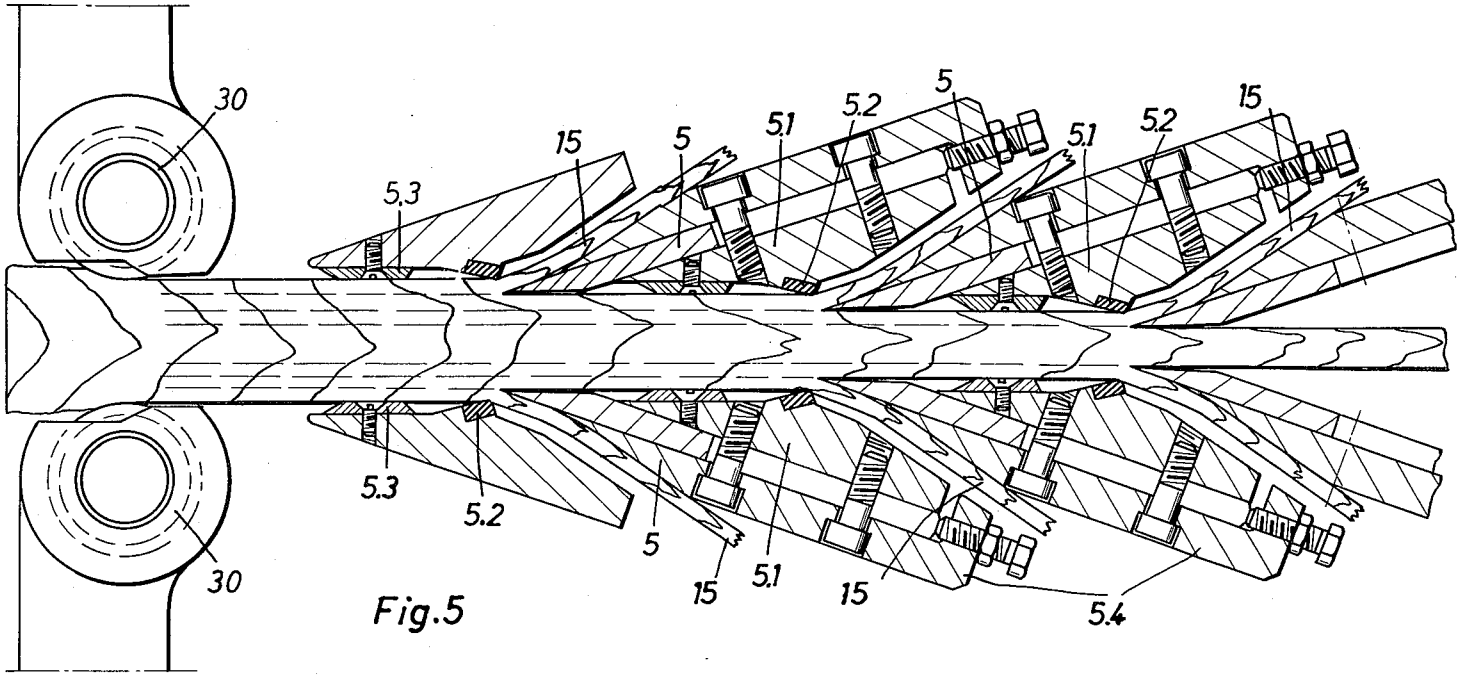
FIG. 5 shows an enlarged longitudinal section through the tools in the machining zone of the apparatus of FIG. 1.
Figure 6:
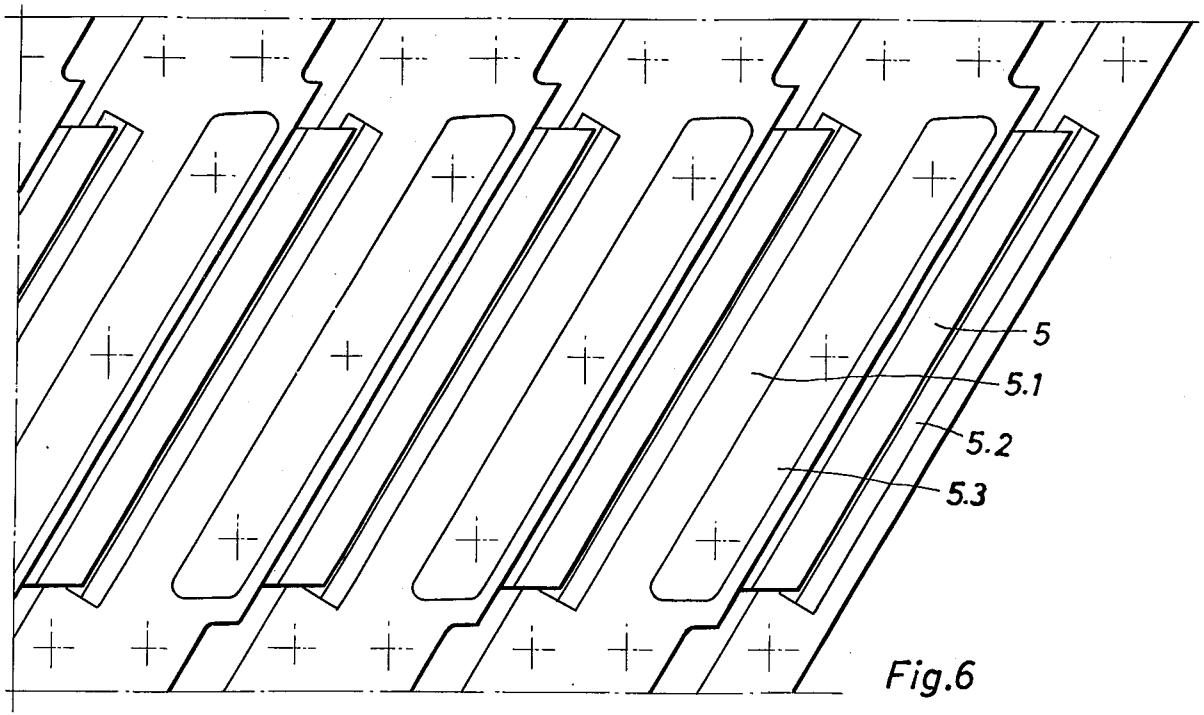
FIG. 6 shows a partial side elevation of the tools in the machining zone.

FIGS. 5 and 6 show the tool arrangement in detail. In each case a cutter holder 5.1 carries a cutter 5 for adjustment in the longitudinal direction and forms, with a presser strip 5.2, a sliding and presser edge for the board or plank 15 leading to the subsequent cutter. This edge prevents the wedge gap, produced by the cutter 5, from advancing too far and causing a split in the timber. At the same time the timber is guided in th processing region by the presser strips 5.2. Each cutter 5 is adjustably secured to the cutter holder 5.1 by a screwed-on clamp plate 5.4.

For further guidance and influencing of the surface quality, guide strips 5.3 are fitted on each cutter holder 5.1, each guide strip being positioned before the associated presser strip 5.2 in the processing direction. Like the presser strips 5.2, the guide strips 5.3 preferably consist of a material having a great resistance to abrasion, for example sintered hard metal or sintered bronze.

As may be seen from FIG. 5, each guide strip 5.3 lies approximately centrally between the associate presser strip 5.2 and the preceding cutter 5. In operations opposed guide strips 5.3, the leading edges of which are bevelled, guide the timber between them and in doing so at the same time exert a pressure from both sides upon the timber surfaces. Thus the occurence of cracks or splits is largely avoided. Also the timber surface arrives at the next presser strips 5.2. already smoothed and at least partially compacted. When the timber being machined has different hardnesses from one side to the other, the guide strips 5.3 prevent the occurrence of unilateral yielding in the region of the presser strips 5.2. This is of great importance in order to minimize scoring. As may also be seen from FIG. 5, the cutting edge of each cutter 5 lies approximately level with or just behind the associated presser strip 5.2, whereby the swarfless severance operation commences in the immediate vicinity of the presser strips 5.2.

FIG. 5 further shows that before each of the first cutters 5, in the direction of movement of the timber, there is arranged a presser strip 5.2, and before this there is arranged a guide strip 5.3. The timber surface coming to the first guide strips 5.3 may be pre-smoothed by milling tools 30, if desired.

FIG. 6 shows in detail the oblique, staggered arrangement of the cutters 5, the presser strips 5.2 allocated to each cutter edge and extending over the whole length thereof, and the guide strips 5.3 arranged parallel with the cutter edges and the presser strips 5.2 and likewise extending over their whole length. Since each group of cutters 5, cutter holders 5.1, presser strips 5.2 and guide strips 5.3 are arranged in a common frame which is driven in an oscillating movement, the guide strips 5.3 also carry out an oscillating movement. Thus not only is there achieved a reduction of the friction force between the guide strips 5.3 and the timber surface, but with relatively low expenditure of force an additional smoothing action is achieved, since the guide strips 5.3 even out irregularities of the timber surface not only in the direction of movement of the timber but also transversely thereof.

The guide strips 5.3 may be secured in grooves, for example dovetail grooves, in the cutter holders 5.1, or may be attached directly thereto by screwing, soldering or adhesive. The presser strips 5.2 may also be secured to the cutter holder 5.1 in a similar manner.

Before machining the round timber logs may be prepared in the usual way by watering, boiling or steaming, also with chemical additives, according to the type of timber.

I claim:

1. Apparatus for producing timber from elongated, round or substantially round timber logs, comprising:

a feeding device for receiving a log and advancing the log axially;

two spaced, opposed banks of staggered cutters that are respectively disposed progressively closer to the longitudinal axis of said log in the direction of advance of said log;

means for oscillating said banks of cutters for separating wood sections from said log as the latter is advanced;

at least one presser element disposed ahead of a corresponding associated one of said cutters in the direction of advance of said log for engaging said log and preventing the wedge gap produced by the associated cutter from extending beyond the cutter to an extent to produce a split in the log; and at least one guide located ahead of a corresponding associated one of said elements in the direction of advance of said log for slidably engaging said log ahead of the formation of said wood sections and exerting pressure against the log to minimize the formation of cracks or splits.

2. Apparatus as set forth in claim 1 including means operatively coupling said at least one guide to the associated cutter therebehind in the direction of advance of said log for oscillation of the cutters and guides in unison.

3. Apparatus as set forth in claim 1 wherein said at least one presser element includes an edge for engaging said log.

4. Apparatus as set forth in claim 1 wherein said at least one guide is in the form of a guide strip.

* * * * *